US005460023A

United States Patent [19]

Ginzburg

[11] Patent Number: 5,460,023

[45] Date of Patent: Oct. 24, 1995

[54] ROLL SURFACE RESTORATION SYSTEM AND METHOD

[75] Inventor: Vladimir B. Ginzburg, Pittsburgh, Pa.

[73] Assignees: International Rolling Mill Consultants Inc.; Danieli United, Inc., both of Pittsburgh, Pa.

[21] Appl. No.: 102,348

[22] Filed: Aug. 5, 1993

Related U.S. Application Data

[63] Continuation-in-part of Ser. No. 759,505, Sep. 13, 1991, abandoned.

[51] Int. Cl.[6] ..... B21B 28/02

[52] U.S. Cl. ..... 72/43; 72/236

[58] Field of Search ..... 72/201, 236, 39, 72/43

[56] References Cited

U.S. PATENT DOCUMENTS 4,750,343 6/1988 Richter et al. ..... 72/17

FOREIGN PATENT DOCUMENTS 0160806 12/1981 Japan ..... 72/236
0118221 7/1984 Japan ..... 72/39
0030505 2/1985 Japan ..... 72/236
0147901 7/1986 Japan ..... 72/236
0283411 12/1986 Japan ..... 72/39
0005811 1/1988 Japan ..... 72/236
0084706 4/1988 Japan ..... 72/236
0183708 7/1988 Japan ..... 72/236

*Primary Examiner*—Lowell A. Larson
*Assistant Examiner*—Thomas C. Schoeffler
*Attorney, Agent, or Firm*—Armstrong, Westerman, Hattori, McLeland & Haughton

[57] ABSTRACT

Method and apparatus for cleaning oxide scale from rolling mill rolls comprises a cleaning spray system including a fluid header juxtaposed to a mill work roll and an associated backup roll and a plurality of nozzles equidistantly spaced along the length of the header. High pressure cleaning water sprays, for which water is supplied by a descaling pump when not in use for descaling, are directed onto a work roll, and by rotation of the header, then directed onto the associated backup roll. The water sprays are directed against the rolls at an angle from 3° to 10° for optimum removal of oxide scale. For even restoration of the roll surface, the cleaning spray system periodically during the cleaning operation is shifted axially along the length of the rolls a distance about one-half the spacing between adjacent nozzles.

9 Claims, 3 Drawing Sheets

ROLL SURFACE RESTORATION SYSTEM AND METHOD

CROSS REFERENCE TO RELATED APPLICATIONS

This application is a continuation-in-part of application Ser. No. 07/759,505, filed Sep. 13, 1991, in the name of the same inventor, now abandoned.

BACKGROUND OF THE INVENTION

In modern rolling mills, there are a variety of differing rolling processes and procedures for producing finished and semi-finished metal products. Typically, heated slabs or billets (of steel or aluminum, for example), produced by ingot pouring or continuous casting machines, are hot rolled through one or more mill roll stands to produce elongated fininshed or semi-finished products such as plates, sheet, strip, bars, rods, structural shapes and the like. Further finishing steps may include cold rolling, such as the cold rolling of hot strip to cold rolled sheet and strip products. Such roll stands generally comprise at least one pair of work rolls between which the metal workpiece is passed to reduce the thickness dimension and/or to shape the metal workpiece as desired. The work rolls are provided with backup rolls.

During the metal rolling operation, mill rolls are heated by a work heat due to the plastic deformation of the rolled metal, a frictional heat generated between the rolled metal and the work rolls, and, in case of hot rolling, heat transfer from the hot metal workpiece. Particularly in the case of hot rolling steel, where a steel workpiece to be rolled is preheated to temperatures in excess of 1200° C. roll heating as a result of heat transfer can become excesssive.

Because of such roll heating, it is essential in practically all metal rolling operations that means be provided to cool the rolls during use and thereby prevent thermal expansion of the rolls and roll surface deterioration, each of which can adversely affect the quality of the rolled product and reduce the service life of the rolls.

While numerous differing types of apparatus have been utilized to cool rolling mill rolls, most have been based on the provision of a line of coolant nozzles spaced along a side surface of the roll parallel to the roll axis, and positioned on either or both the entrance and/or the exit side of the roll. Typically, an elongated spray bar, i.e. a manifold or header, having a width substantially equal to the width of the roll, is closely positioned parallel to the roll. The spray bar is provided with a plurality of spaced spray nozzles to direct the water or other coolant from the manifold onto the rotating roll, generally with a nozzle pressure of less than about 100 pounds per square inch (psi) (7 bars). Normally, one or several such spray bars are provided having a fixed flow rate and pressure as will achieve an optimum cooling rate, i.e. a cooling rate as necessary to keep the roll temperature within determined temperature limits. Since the roll surface is heated quite significantly and very rapidly at the roll bite, i.e. while in contact with and working the heated workpiece, the prior art practice has been to utilize a coolant flow rate and pressure as will cool the roll surface as significantly and nearly as rapidly as it is heated. Hence, the more rapidly and excessively a roll becomes heated, the more rapidly and excessively it is cooled. This necessitates the provision of one or more pumps of relatively high fluid pumping capacity.

Particularly in the case of hot rolling steel products, wherein workpiece temperatures normally are in excess of 1200° C., and utilizing conventional roll cooling apparatus, roll surface deterioration can progress rather rapidly as a result of "firecracking," i.e. cracks occuring in the roll surface resulting from thermal fatigue stresses, which thereafter leads to roll "banding," i.e. bands of lost surface metal occurring circumferentially around the roll surface. These phenomena not only result in a reduced surface quality of the rolled product, but also cause mill scale and other oxides dislodged from the roll surface to be rolled in the surface of the workpiece to further reduce the product's surface quality.

Based on numerous studies, the surface deterioration of hot rolling mill rolls, as a result of thermal fatigue stresses, has been found to be characterized by the following sequence of events:

a. Formation of thermal fatigue cracks.

The formation of fine thermal fatigue cracks in the surface of a rolling mill roll will start to form after only a few revolutions of the roll. These cracks tend to form and grow primarily in a direction perpendicular to the roll surface and to penetrate to a depth governed by the magnitude of temperature gradients caused by the very rapid alternate heating and cooling of the roll during a rolling operation. In rolls subjected to a heavy thermal load and good cooling, the crack depth may approximate 250 micrometers (0.010 inch). The cracks will grow and intersect to form cells of various sizes on the roll surface. For example, near the outer surface of the rolls, where temperature gradients are very high, a very fine crack network will be effected with cells having side dimensions of 25 to 50 micrometers (0.001 to 0.002 inch. The deeper cracks will define larger cells having side dimensions of 250 to 500 micrometers (0.010 to 0.020 inch).

b. Formation of subsurface cracks.

Subsurface cracking will occur simultaneously with surface cracking at depths of 250 micrometers (0.010 inch) beneath the roll surface and oriented parallel to the roll surface. While these subsurface cracks could be thermal in origin, it is believed that they ore more likely caused by the mechanical stresses resulting from the pressures imposed by the workpiece and backup roll. The number of these horizontal cracks will decrease at increased depth below the surface.

c. Oxidation of crack surfaces.

The interfaces of both the surface and subsurface cracks, being exposed to highly corrosive gases or liquids, such as cooling water and steam, quickly form oxides within the interface gaps.

d. Growth of defective areas.

Because the oxide formations will grow and thicken within the crack interfaces, additional stresses will be imposed at the surface of the roll, producing a wedging action on the cells similar to that in stress corrosion.

e. Removal of the roll cells.

In advanced stages, pieces of the roll surface become completely surrounded by oxide products and are either removed from the surface of the roll by the rolling mechanical forces or by the wedging action of the oxide products. These loosened particles may be rolled back into the roll surface or may be rolled into the surface of the workpiece as mill scale. The plastic flow of roll particles near the surface (within 25 micrometers (0.001 inch) indicates the presence of very high shear stresses which will dislodge cells that are loosely attached.

f. Banding

The banding process is a macro deterioration of the roll surface that results from the removal of many close or side-by-side cells, often resulting in elongated bands of removed surface cells. The bands normally propogate circumferentially because the surface shear stresses due to rolling are circumferentially imposed, and because the loss of neighboring cells will reduce attachment forces and facilitate additional cell removal at the edge.

The oxide surface that is found on the roll surface, while it is still thin, plays a positive role by protecting the actual roll metal surface from thermal shocks. Therefore, there is an optimum thickness of the oxide layer on a roll that should be maintained. The present method and apparatus partially remove the oxide layer, leaving some oxide for the aforesaid protective purposes.

SUMMARY OF THE INVENTION

According to the present invention, there is provided an apparatus and method of cleaning rolling mill rolls by partially removing the oxide scale from the rotating rolls. Such a mill is provided with at least one pair of work rolls and at least one pair of associated backup rolls, and roll cooling and workpiece cooling and descaling means including a descaling fluid, e.g. water, pump. For the purposes of the invention, there are provided a cleaning spray means comprising an elongated water header extending substantially across a width dimension of the rolls and adjacent thereto, and at least one water spray nozzle disposed in the water header and adapted to project at least one water spray onto the rolls; means to rotate the cleaning spray means from a direction in which a water spray is directed onto a work roll to a direction in which a water spray is directed onto a corresponding backup roll, means periodically axially to shift the spray means in a direction of a length dimension of the water header, and means to supply water to the header from the pump when the pump is not supplying water for descaling.

DESCRIPTION OF PREFERRED EMBODIMENTS

Figure 1:
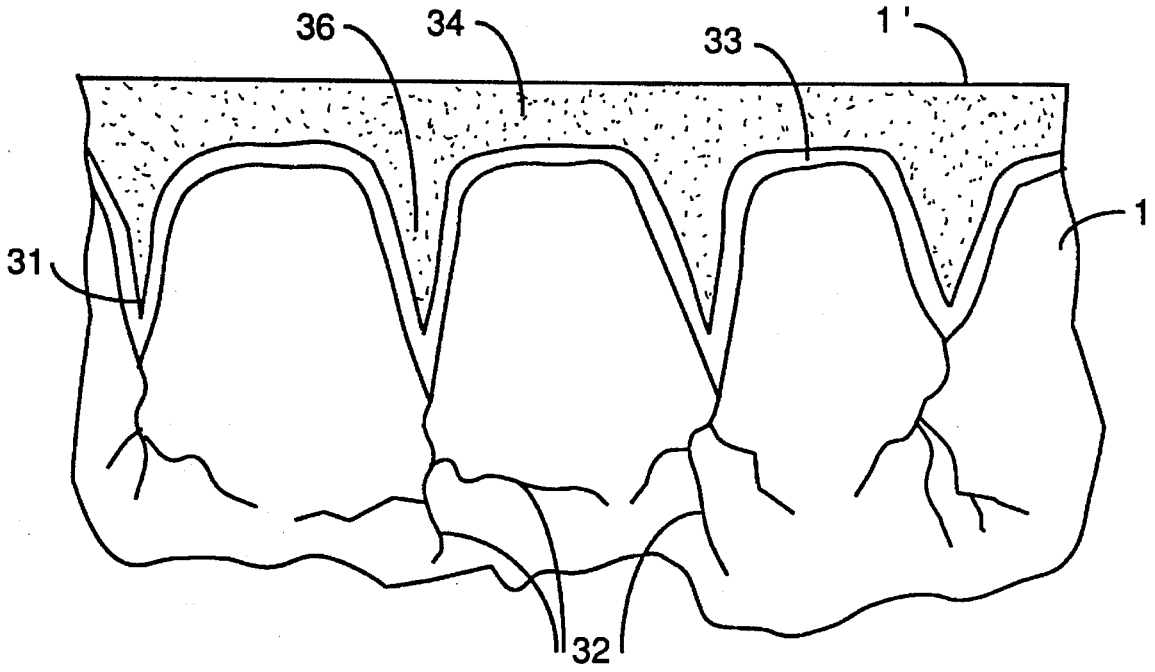
FIG. 1 is a partial cross-sectional view of a metal work roll, showing surface and subsurface cracks and oxide scale formed on the roll as a result of rolling operation.

FIG. 1 shows a work roll 1 having surface cracks 31 and subsurface cracks 32 as a result of rolling operation. As there depicted in exaggerated size, the surface cracks 31 extend generally perpendicularly with respect to the roll surface and are covered with a layer of oxide 33. Compacted oxide 34 with embedded corrosion debris 36 covers the roll, forming a surface 1'.

Figure 2:
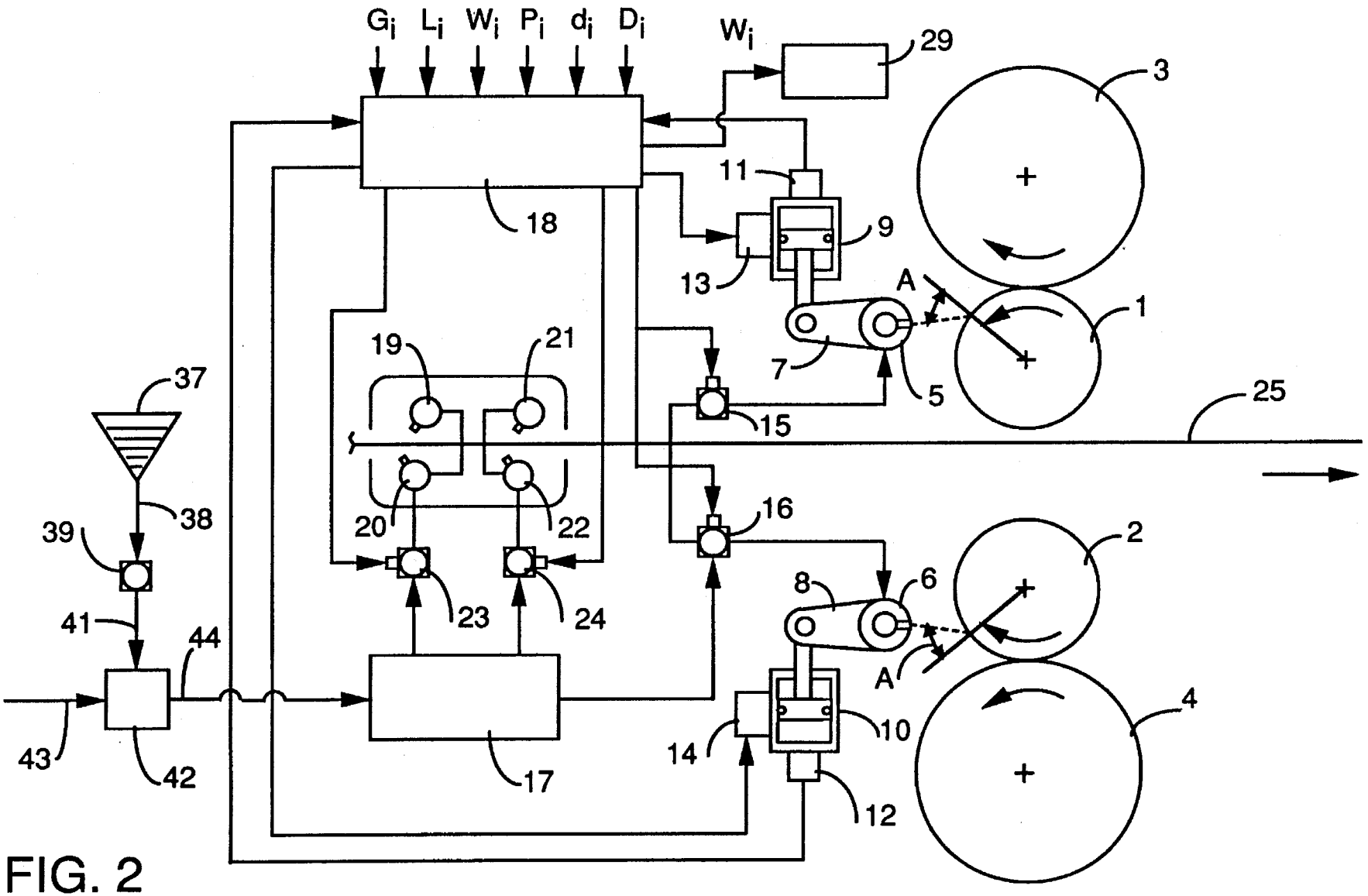
FIG. 2 is a schematic representation, in side elevation, of an apparatus of the invention.

FIG. 2 shows a 4-high rolling mill stand comprising a pair of work rolls 1, 2 and a pair of backup rolls 3, 4. Rolls 1, 2, 3 and 4 in operation are cooled by conventional cooling means (not shown). A pump 17 supplies descaling water to strip descaling headers 19, 20, 21 and 22 through electrically controlled valves 23, 24. According to the invention, there is provided a roll cleaning spray system comprising a top header 5 and a bottom header 6 that spray a fluid, such as water, or a mixture of water and an abrasive material, along either work rolls 1 and 2 or backup rolls 3 and 4. The water pressure is between 1000 and 4000 pounds per square inch (psi), preferably about 2000 psi. Water flow rate is between 0.5 to 5 gallons per minute (gpm) per inch of roll width, preferably about 1 gpm per inch of width.

Headers 5 and 6 can be designed with either spray nozzles spaced equidistantly apart along the longitudinal roll axes or with single slots extending longitudinally along the length dimension of the headers to provide more even distribution of water flow.

The angular position of the headers 5 and 6 can be adjusted for the following purposes:

a. To obtain an optimum spray angle A that is defined between the spray and a line drawn perpendicular to the roll surface at the point of the spray contact with the roll. At the optimum angle A, removal of a desired thickness of the oxide layer is achieved in a minimum time. The goal is to reduce reduction of the thermal crown (the hottest and hence the thickest central portion of the roll) and to reduce the time delay for restoration of the roll surface.

b. To direct the sprays toward either the work rolls 1 and 2 or the backup rolls 3 and 4.

The headers 5 and 6 can be rotated around their axes by hydraulic cylinders 9 and 10 through lever arms 7 and 8. Cylinder extension is provided through a cylinder position control system that incorporates servovalves 13 and 14 and position transducers 11 and 12 as feedback control devices.

The roll restoration process is carried out during the gap time, that is, when there is no metal in the roll bite. This provides the advantages that (a) there is no disturbance of the roll heat balance, and (b) there is no need for the supply of additional water because the available capacity of the roll cooling and strip descaling pump is not utilized during operation of the cleaning spray means. The high pressure water is supplied to the headers 5 and 6 from the water pump 17 through electrically controlled valves 15 and 16 during the time periods when pump 17 is not supplying descaling water to the mill.

Figure 3:
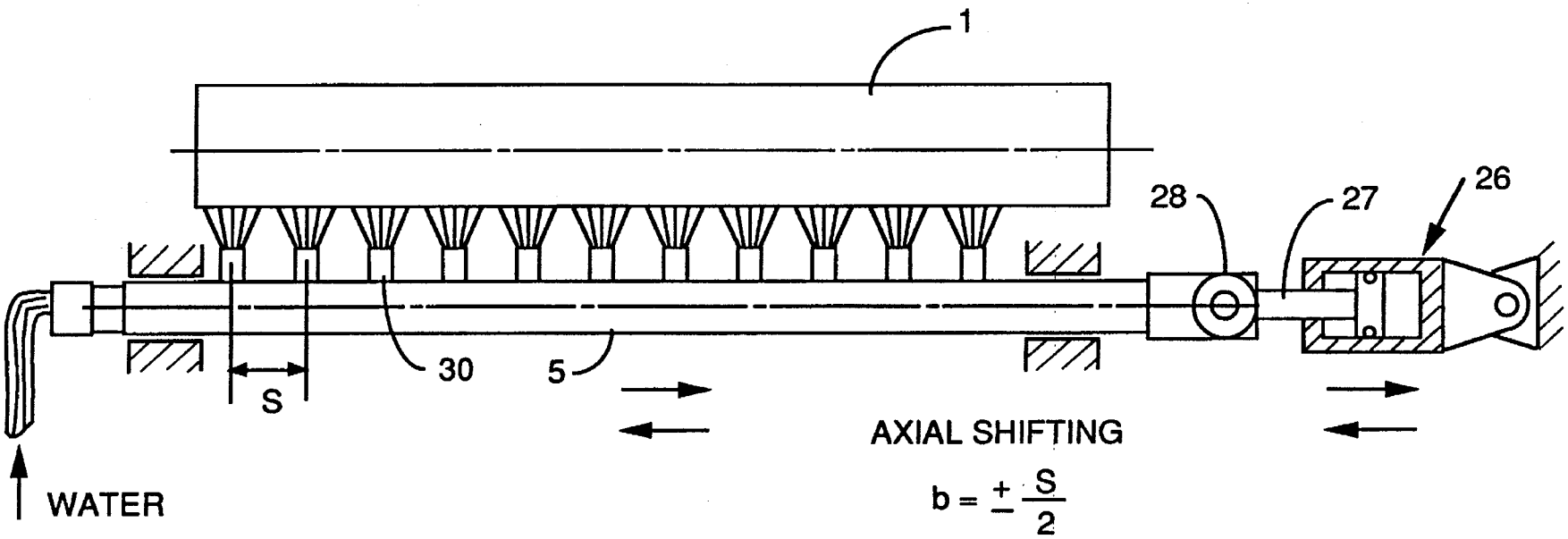
FIG. 3 is a plan view of a part of the apparatus of FIG. 2, showing means to axially shift a cleaning spray means with respect to a roll being cleaned.

When a plurality of spray nozzles 30 (FIG. 3) are used in the cleaning spray system, equally spaced apart by a distance S (FIG. 3), an even restoration of the roll surface can be provided by a periodic reciprocating shifting of the headers 5 and 6 in the longitudinal direction of the headers and rolls. The length of the shifting stroke is plus or minus approximately one-half S—the distance between adjacent nozzles 30. The shifting operation is actuated by means of a pair of cylinder/piston arrangements, one of which, 26, comprising a piston 27 one end 28 of which is connected to a header 5, is illustrated in FIG. 3. Operation of the pistons is controlled by means of a controller 29 (FIG. 2) which is connected to a computer 18.

To increase the efficiency of the surface restoration process, finely divided abrasive substances, such as sand, enhancing removal of the oxide layer, can be added to the water. For this purpose, there is provided an abrasive material hopper 37 (FIG. 2), connected by line 38 to a flow control valve 39, through line 41 to a mixer 42 supplied with water through line 43, feeding the water/abrasive mixture through line 44 to headers 5 and 6.

The cleaning spray system will be activated for a time, T, after either a predetermined number of pieces, N, or a predetermined length, L, of product has been rolled. Computer 18 (FIG. 2) is provided for input of data regarding composition of the material being rolled, G, length of product rolled, L, width of the product, W, roll force, P, draft, d, and work roll diameter, D, and the values of T and the optimum angle A are calculated. It has been found that the angle A for optimum removal of oxide scale in accordance with this invention lies within the range of about 15° to 60°.

It has been further found that cleaning of mill rolls in accordance with the invention is further enhanced by oscillating the fluid header about its longitudinal axis. Such oscillation can be effected by means of control valves 15 and 16, and preferably is through an angle of about plus or minus 3°–5° with respect to a selected angle A, with a frequency of about 1–5 cycles per second.

The optimum amount of oxide to be removed during roll surface restoration must be determined empirically in each case.

What is claimed is:

1. A method of cleaning rolling mill rolls by partially removing oxide scale from rotating rolls of a hot rolling mill for rolling an elongated metal work piece, said mill having work rolls and opposed backup rolls and workpiece descaling means including a descaling fluid pump, said method comprising:

directing onto the work rolls a cleaning fluid spray having a pressure of about 1000 to 4000 psi from a cleaning fluid spray means comprising an elongated cleaning fluid header extending substantially the width of the rolls and juxtaposed thereto, and a plurality of cleaning fluid spray nozzles from which a cleaning fluid spray is directed toward the rolls;

after the work rolls are cleaned, rotating the cleaning fluid spray means about a longitudinal axis of the cleaning fluid header and directing the cleaning fluid spray onto the backup rolls;

activating the cleaning fluid spray means in time intervals between rolling a workpiece between the work rolls, and providing cleaning fluid for the cleaning fluid spray means by the pump that, during rolling of a workpiece, provides descaling fluid for workpiece descaling.

2. A method according to claim 1, wherein cleaning fluid spray is directed toward a roll to be cleaned at an angle, A, from about 15 degrees to about 60 degrees between the direction of a spray nozzle and a line drawn perpendicular to the roll surface at the point of spray contact with the roll, and oscillating the cleaning fluid header about its longitudinal axis about 3–5 degrees relative to angle A with a frequency of about 1–5 cycles per second.

3. A method according to claim 2, wherein the cleaning fluid comprises water and a particulate abrasive material to aid in removing oxide scale from the mill rolls.

4. A method according to claim 2, wherein cleaning fluid flow rate is between about 0.5 and 5 gpm per inch of roll width.

5. A method according to claim 2, wherein cleaning fluid pressure in the cleaning fluid header is between about 1500 and 2500 psi, and cleaning fluid flow rate is about 0.75 to about 1.5 gpm per inch of roll width.

6. A method according to claim 1, which further comprises periodically during cleaning of a roll, axially shifting the cleaning fluid header along the longitudinal axis of the cleaning fluid header.

7. A method according to claim 6, wherein the cleaning spray means comprises a plurality of nozzles equidistantly spaced apart along a length dimension of the cleaning fluid header, and further comprising shifting the cleaning fluid header a distance equal to about one half of the distance between adjacent nozzles.

8. A method according to claim 1, wherein the cleaning spray system is activated for a time, T, with the fluid spray directed onto a roll at an angle A between the direction of the spray and a line drawn perpendicular to the roll surface at a point of spray contact with the roll, and T and A are calculated by a computer as a function of workpiece parameters including chemical composition, G, length, L, and width, W, of the workpiece, roll force, P, draft, d, and work roll diameter, D.

9. A roll surface restoration system for a mill for hot rolling an elongated metal workpiece, said mill having at least one pair of work rolls and at least one pair of associated backup rolls, and workpiece descaling means including a descaling fluid pump, said system comprising:

a cleaning fluid spray means comprising:

an elongated cleaning fluid header extending substantially across a width dimension of the rolls and adjacent thereto, and at least one cleaning fluid spray nozzle disposed in the cleaning fluid header and adapted to project at least one cleaning fluid spray onto the rolls;

means to rotate the cleaning fluid spray means from a direction in which a cleaning fluid spray is directed onto a work roll to a direction in which a cleaning fluid spray is directed onto a corresponding backup roll, said rotating means including at least one lever arm on one end of which the fluid header is mounted and the other end of which is pivotally connected to a piston rod of a cylinder/piston assembly;

means to oscillate the cleaning fluid spray about a longitudinal axis of the cleaning fluid header;

means to supply cleaning fluid to the header for roll cleaning from the pump when the pump is not supplying descaling fluid for workpiece descaling during rolling;

a control valve for controlling the flow of fluid from the fluid pump to the fluid header;

a computer;

a position transducer connected to the computer for information regarding position of the piston in the cylinder/piston assembly, and a servo valve connected to the computer for receiving information from the computer for actuating the servo valve and thereby activating rotation of the cleaning fluid header, said computer also being connected to the control valve and actuating the same for control of flow of fluid from the fluid pump to the fluid header.

* * * * *